United States Patent [19]

Sugiyama et al.

[11] Patent Number: 4,491,921

[45] Date of Patent: Jan. 1, 1985

[54] METHOD AND APPARATUS FOR CONTROLLING THE AIR FUEL RATIO IN AN INTERNAL COMBUSTION ENGINE

[75] Inventors: Shinichi Sugiyama; Yoshiki Chujo, both of Susono; Takehisa Yaegashi, Mishima, all of Japan

[73] Assignee: Toyota Jidosha Kogyo Kabushiki Kaisha, Toyota, Japan

[21] Appl. No.: 333,319

[22] Filed: Dec. 22, 1981

[30] Foreign Application Priority Data

Dec. 23, 1980 [JP] Japan ..... 55-181208
Dec. 23, 1980 [JP] Japan ..... 55-181209

[51] Int. Cl.[3] ..... F02B 3/00; F02D 33/00

[52] U.S. Cl. ..... 364/431.05; 123/489; 123/440

[58] Field of Search ..... 364/431.05, 431.06; 123/440, 489, 589

[56] References Cited

U.S. PATENT DOCUMENTS 4,167,925 9/1979 Hosaka et al. ..... 123/440
4,263,652 4/1981 Henrich ..... 364/431.12
4,290,107 9/1981 Suda et al. ..... 124/440 X
4,314,537 2/1982 Asano et al. ..... 123/440
4,324,218 4/1982 Hattori et al. ..... 123/440
4,345,562 8/1982 Drews et al. ..... 123/489 X
4,348,727 9/1982 Kobayashi et al. ..... 364/431.05
4,348,728 9/1982 Sagisaka et al. ..... 364/431.05 X
4,354,238 10/1982 Manoka et al. ..... 364/431.05
4,355,615 10/1982 Asano et al. ..... 123/440 X
4,357,828 11/1982 Nakano ..... 123/440 X
4,359,029 11/1982 Furuhashi et al. ..... 123/489 X

*Primary Examiner*—Gareth D. Shaw
*Assistant Examiner*—Ronni S. Malamud
*Attorney, Agent, or Firm*—Cushman, Darby & Cushman

[57] ABSTRACT

An output voltage from an $O_2$ sensor is intermittently sampled and the sampled voltage is converted into a binary signal. The binary signal is applied to an electrical digital computer, and therein the following operations are carried out. First, the maximum value and minimum value of the applied binary signal are detected, then the difference between the maximum and minimum values and the sum of the maximum and minimum values are calculated. A reference value is calculated using the calculated difference and sum and the minimum value from a predetermined algebraic function. Thereafter, the applied binary signal is compared with the calculated reference value to generate a binary signal indicative of the comparison result. Then, the air-fuel ratio of the engine is adjusted in response to this binary signal calculated by the digital computer.

24 Claims, 17 Drawing Figures

| |
|---|
| Fig. 10A |
| Fig. 10B |

60
Vox IS INTRODUCED
120
IS F/B EXECUTION FLAG ON ?
NO
YES
121
β ← 1
61
IS RICH FLAG ON ?
YES
NO
62
IS Vox ≧ V'ox ?
YES
NO
63
VMIN IS DETECTED AND STORED
67
D ← VMAX+VMIN / V o
65
IS Vox≧V'ox ?
YES
NO
66
VMAX IS DETECTED AND STORED

130
IS STARTING STATE ?
YES
NO
132
IS UNDER FUEL CUT OPERATION ?
YES
NO
133
IS UNDER FUEL INCREMENT OPERATION ?
YES
NO
134
IS FIRST CYCLE AFTER OPERATION ?
YES
135
TIMER IS STARTED
NO
136
IS>TIME G MEASURED ?
NO
YES
137
IS F/B PERMISSION FLAG ON ?
NO
139
IS Vox ≧ H ?
NO
YES
YES
138
F/B EXECUTION FLAG IS TURNED ON
131
F/B EXECUTION FLAG IS TURNED OFF

METHOD AND APPARATUS FOR CONTROLLING THE AIR FUEL RATIO IN AN INTERNAL COMBUSTION ENGINE

BACKGROUND OF THE INVENTION

The present invention relates to an air-fuel ratio feedback control method and apparatus of an internal combustion engine, more specifically to an air-fuel ratio feedback control method and apparatus using an electrical digital computer.

An internal combustion engine, in general, emits gases containing pollutants such as carbon monoxide (CO), nitrogen oxides (NOx), and unburned or partly burned hydrocarbons (HC). When these pollutants are to be cleaned using a three-way catalytic converter, it is required to highly and precisely control the air-fuel ratio within a range around the stoichiometric air-fuel ratio such that all of the three components, i.e., CO, NOx, and HC can be removed effectively.

Therefore, the internal combustion engine employing the above-mentioned three-way catalytic converter usually adopts a method of controlling the feedback of air-fuel ratio responsive to signals from a concentration sensor (exhaust gas sensor) which detects the concentrations of particular components in the exhaust gas. Among many concentration sensors, an oxygen concentration sensor (hereinafter referred to an $O_2$ sensor) for detecting the oxygen concentration has been extensively used for automobiles, such as a stabilized zirconia element or a titania element. When the air-fuel ratio in the atmosphere hovers around 14.5 (stoichiometric air-fuel ratio) this type of $O_2$ sensor suddenly changes in electric properties. More specifically, the $O_2$ sensor detects the changes in the air-fuel ratio which causes the electric signals thereof to change.

The $O_2$ sensors, however, differ in characteristics depending upon the individual unit and also greatly vary in temperature characteristics. Therefore, in order to control the air-fuel ratio over a wide range of temperatures of the engine, while suppressing control errors that may stem from individual characteristics, a particular contrivance must be provided to process the output voltage of the $O_2$ sensor. One method is to vary or control a reference voltage for comparison. Namely, the output voltage of the $O_2$ sensor is compared with the reference voltage by a comparator, to discriminate whether the air-fuel ratio at the present moment is on the rich side or on the lean side relative to the stoichiometric condition. In this case, the reference voltage for comparison can have variable values responsive to a maximum value in the output voltage of the $O_2$ sensor.

The present inventors have already proposed a method for controlling the air-fuel ratio by using a variable reference voltage dependent upon the maximum and minimum value in the output voltage of the $O_2$ sensor (U.S. application Ser. No. 276,996). In this method, the variable reference voltage $V_R$ of the comparator is obtained from the equation of $V_R = V_{MAX} \cdot K_1$ or $V_R = (V_{MAX} - V_{MIN}) \cdot K_2 + V_{MIN}$ where $V_{MAX}$ is the maximum value, $V_{MIN}$ is the minimum value of the output voltage of the $O_2$ sensor, and $K_1$ and $K_2$ are constants.

However, when using a semiconductor type $O_2$ sensor, such as a titania element type, which transduces the change in the oxygen concentration to the change in its inner resistance, the above-mentioned control method set forth by the present inventors cannot precisely control the air-fuel ratio in response to the wide change in temperature of the $O_2$ sensor was because the inner resistance of the semiconductor type $O_2$ sensor greatly changes along with changes in its temperature. As is well known, the resistance of a semiconductor element increases when the temperature thereof decreases, and vice versa. Therefore, if a constant dc voltage is applied across the semiconductor type $O_2$ sensor and a resistor having a fixed resistance connected so that the $O_2$ sensor is made positive with respect to the resistor, the maximum value and minimum value of the voltage derived from the junction of the $O_2$ sensor and the resistor change depending upon the $O_2$ sensor's temperature, as follows. During low temperature, not only the minimum value but also the maximum value of the derived voltage change to approach to zero. Contrary to this, during high temperature, not only the maximum value but also the minimum value of the derived voltage change to approach the applied constant voltage. Therefore, precise air-fuel ratio control cannot be executed if the reference voltage for the comparison is merely varied in response to the maximum value of the output voltage from the $O_2$ sensor, or to the difference between the maximum value and the minimum value of the output voltage, by using the above equation of the first degree. As a result, the air-fuel ratio is controlled to a ratio on the rich side with respect to a desired ratio at a low temperature of the $O_2$ sensor, or the exhaust gas and vice versa.

Furthermore, if the temperature of the $O_2$ sensor or the exhaust gas is extremely high, for example, above 750° C., the air-fuel ratio will not be precisely controlled by the feedback loop, and is controlled to a ratio on the lean side relative to a desired ratio. Thus further overheats the catalytic converter and extraordinarily decreases the engine torque.

SUMMARY OF THE INVENTION

It is, therefore, an object of the present invention to provide a method and an apparatus for controlling the air-fuel ratio in an internal combustion engine, whereby the air-fuel ratio can be precisely controlled close to a desired ratio under various operating conditions of the engine.

Another object of the present invention is to provide a method and an apparatus, which can detect an extremely high increase in the exhaust gas temperature, without using a special exhaust gas temperature sensor, so as to stop the air-fuel ratio feedback control.

According to the present invention, there is provided a method for controlling the air-fuel ratio in an internal combustion engine having an exhaust gas sensor, for detecting the concentration of a predetermined component in the exhaust gas of the engine and for generating a voltage signal which represents the detected concentration, and having an electrical digital computer comprising the steps of: intermittently sampling the voltage signal from the exhaust gas sensor and converting the sampled voltage signal into an electrical signal in the form of a binary number; detecting the maximum value and the minimum value of the binary electrical signal to generate a maximum valve signal and a minimum value signal by means of the digital computer; calculating, in response to the maximum value signal and the minimum value signal, a first value which is proportional to the difference between the maximum value and the minimum value, and a second value which is proportional to the sum of the maximum value and the minimum value, by means of the digital computer; calculating a reference value which corresponds to the sum of the minimum value and the product of the first value and the second value, by means of the digital computer; changing the value of a reference signal from the previous reference value to the calculated reference value; comparing, by means of the digital computer, the magnitude of the reference signal with the magnitude of the converted binary electrical signal to obtain a binary signal which indicates the comparison result; and adjusting the air-fuel ratio in the engine in response to the binary signal indicative of the comparison result.

Furthermore, according to the present invention, there is provided an apparatus for controlling the air-fuel ratio in an internal combustion engine comprising: an exhaust gas sensing means for detecting the concentration of a predetermined component in the exhaust gas of the engine and for generating a voltage signal which represents the detected concentration; a means for intermittently sampling the voltage signal from the exhaust gas sensor and for converting the sampled voltage signal into an electrical signal in the form of a binary number; an electrical digital computer, the computer including means for: (1) detecting the maximum value and the minimum value of the binary electrical signal to generate a maximum value signal and a minimum value signal, (2) calculating, in response to the maximum value signal and the minimum value signal, a first value which is proportional to the difference between the maximum value and the minimum value and a second value which is proportional to the sum of the maximum value and the minimum value, (3) calculating a reference value which corresponds to the sum of the minimum value and the product of the first value and the second value, (4) changing the value of a reference signal from the previous value to the calculated reference value, and (5) comparing the magnitude of the reference signal with the magnitude of the converted binary electrical signal to obtain a binary signal which indicates the comparison result; and means for adjusting the air-fuel ratio in the engine in response to the binary signal indicative of the comparison result.

The above and other related objects and features of the present invention will be apparent from the description of the present invention set forth below, with reference to the accompanying drawings, as well as from the appended claims.

DETAILED DESCRIPTION OF THE PREFERRED EMBODIMENTS

Figure 1:
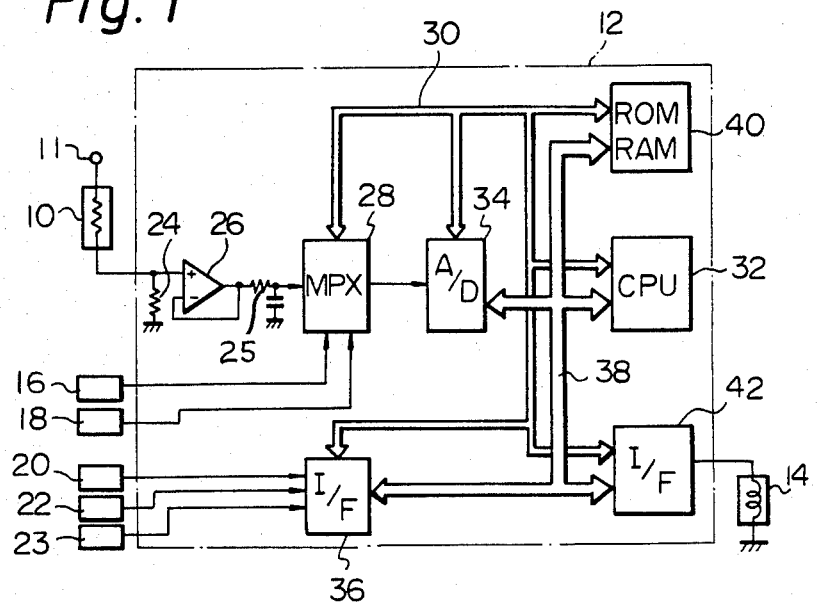
FIG. 1 is a block diagram schematically illustrating an embodiment of the present invention.

FIG. 1 is a block diagram illustrating an embodiment according to the present invention, which employs a semiconductor type $O_2$ sensor, such as a titania $O_2$ sensor. The change of the inner resistance of the $O_2$ sensor is transduced into the change of the output voltage thereof. The device of this embodiment controls the air-fuel ratio by adjusting the amount of fuel supplied from a fuel injection valve responsive to the output voltage of the $O_2$ sensor. In FIG. 1, reference numeral 10 denotes the above-mentioned titania $O_2$ sensor, 11 denotes a power supply terminal through which a positive constant dc voltage, for example, 5 V, is applied to one terminal of the $O_2$ sensor 10, 12 denotes a control circuit including an electrical digital computer, and 14 denotes a fuel injection valve. In addition to signals from the $O_2$ sensor, the control circuit 12 is served with signals from an air-flow sensor 16, a coolant-temprature sensor 18, a running-speed sensor 20, a throttle position switch 22 and a starter switch 23.

The other terminal (output terminal) of the $O_2$ sensor 10 is earthed via resistor 24 having a fixed resistance of about 100 kilohms. Thus, the change of the resistance of the $O_2$ sensor 10 appears as the change of the voltage (hereinafter called output voltage) on the above output terminal.

The output voltage of the $O_2$ sensor 10 is applied to an analog multiplexer 28 via a resistor 25 and a buffer amplifier 26. The analog multiplexer 28 further receives voltage signals representing the amount of air introduced into the engine from the air-flow sensor 16, voltage signals representing the temperature of the coolant from the coolant-temperature sensor 18, and various other analog signals that represent operation conditions of the engine. These analog voltage signals are fed in a time divisional manner to an analog-to-digital converter (A/D converter) 34 owing to control signals that are fed from a central processing unit (CPU) 32 through a control bus 30, and are successively converted into electrical signals in the form of binary numbers.

An input interface 36 is served with binary signals that represent the running speed of the engine produced by the running-speed sensor 20, with signals that represent the opening state of a throttle valve (not shown) produced by the throttle position switch 22, and with signals that represent the starting condition of the engine.

The A/D converter 34 and the input interface 36 are connected via a data bus 38 to the CPU 32, to a memory 40 consisting of a read-only memory (ROM) and a random access memory (RAM), and to an output interface 42. The ROM in the memory 40 preliminarily stores a control program of the digital computer, a variety of operation constants which have been determined beforehand by experiments, and initial values. The output interface 42 receives a value related to the fuel injection time that is calculated by the CPU 32, converts the value into an analog signal and sends it to a fuel injection valve (or valves) 14. Therefore, the opening time of the injection valve 14 is controlled, the amount of fuel injection is controlled, and the feedback of the air-fuel ratio is controlled.

Figure 2:
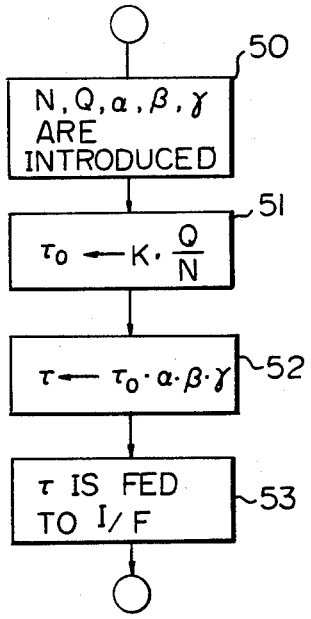
FIGS. 2 and 3 are schematic flow diagrams of parts of control programs in the embodiment of FIG. 1.

It is widely known to arithmetically operate the fuel injection time by utilizing a digital computer. For example, the arithmetic operation is carried out according to a flow chart as schematically illustrated in FIG. 2, although its details are not mentioned here. The CPU 32 executes the arithmetic operation as shown in FIG. 2 responsive to every predetermined crank angle or request of interrupt at every predetermined period of time. At a point 50, the CPU 32 takes out from the RAM the data N related to the running speed, the data Q related to the amount of air intaken, the correction factor $\alpha$ of the water temperature, the correction factor $\beta$ related to the feedback of the air-fuel ratio, and the correction factor $\gamma$ of another engine parameter. These data N and Q are introduced beforehand from the sensors 16 and 20, and are temporarily stored in the RAM. The correction factor $\alpha$ is calculated beforehand responsive to water-temperature signals from the sensors 18, and is temporarily stored in the RAM. The correction factor $\beta$ is calculated by the method of the present invention, as will be mentioned below, and is temporarily stored in the RAM. The correction factor $\gamma$ is related to the acceleration increment of fuel, which is determined in response to the signal from the throttle position switch 22, and is temporarily stored in the RAM.

An arithmetic calculation of $\tau_0=K\cdot Q/N$ is carried out at a point 51, and an operation for correction $\tau=\tau_0\cdot\alpha\cdot\beta\cdot\gamma$ is carried out at a point 52. Here, K represents a constant. The thus calculated value $\tau$ is then fed to the output interface 42 as a fuel injection time.

Figure 3:
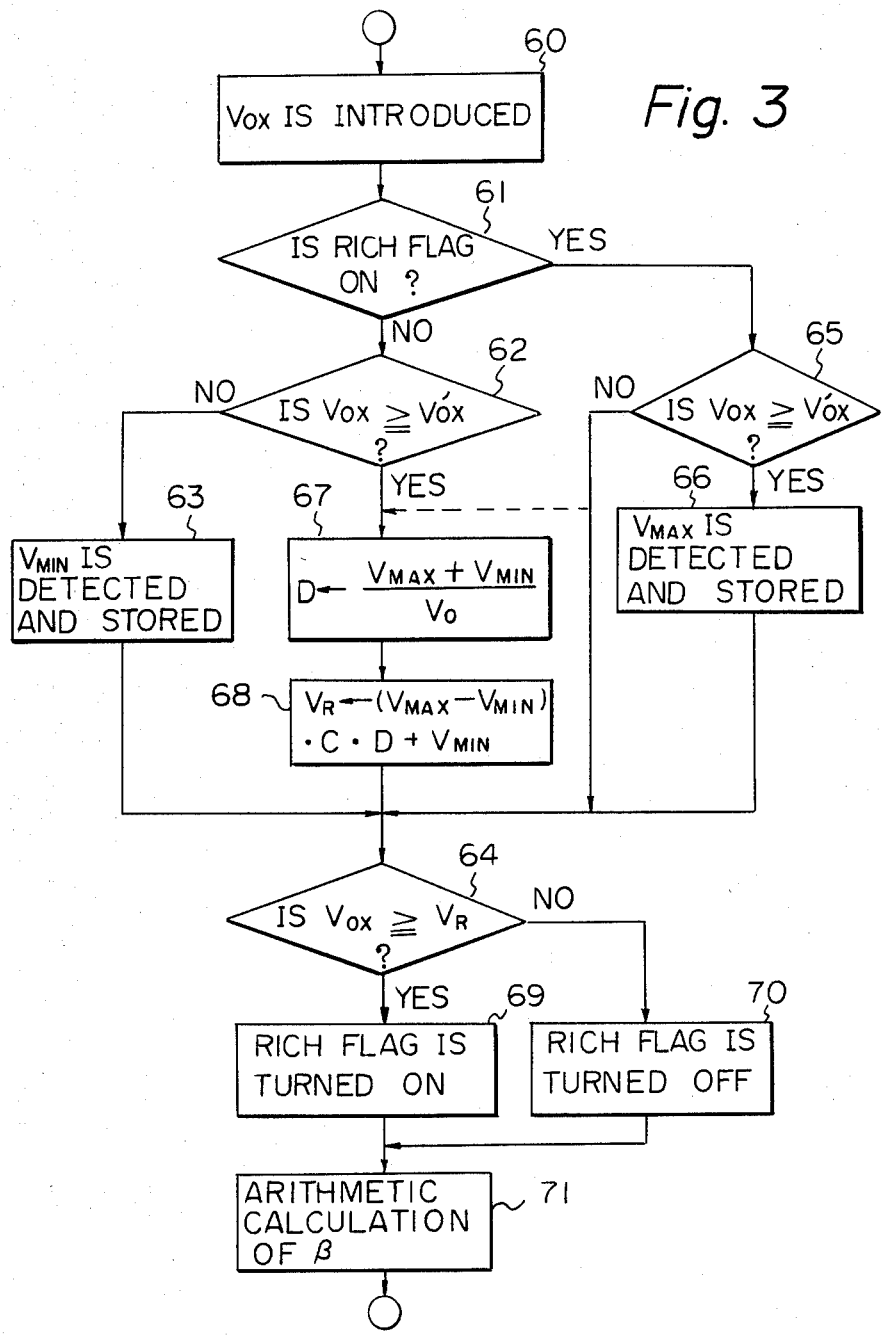

FIG. 3 schematically illustrates a routine for calculating the above-mentioned correction factor $\beta$. The operation of the embodiment will be mentioned below in detail with reference to FIG. 3.

The CPU 32 executes the routine shown in FIG. 3 at every predetermined period of time, for example, at every 4 to 8 msec. At a point 60, first, the CPU 32 introduces an output voltage data Vox of the $O_2$ sensor 10 which is obtained by A/D converting the output voltage from the $O_2$ sensor into a binary signal. Then, at a point 61, the CPU 32 judges whether a rich flag is on or off. The rich flag will have been set to on or off in the previous cycle of arithmetic operation. When the rich flag is off, i.e., when the input data Vox is smaller than a reference value in the previous cycle of arithmetic operation and the engine is in the lean condition, the program proceeds to a point 62 where the magnitude of the input data V'ox in the previous cycle is compared with that of the present input data Vox. The comparison at the point 62 is to judge whether the output voltage of the $O_2$ sensor 10 is increasing or decreasing. When Vox<V'ox, that is when the engine is in the rich condition and when the output voltage of the $O_2$ sensor 10 is decreasing, the program proceeds to a point 63 where the minimum value $V_{MIN}$ of the input data Vox is detected and the detected minimum value $V_{MIN}$ is stored in the RAM of the memory 40. The program then proceeds to a point 64.

If, at the point 61, it is judged that the rich flag is on, i.e., the engine is in the rich condition, the program proceeds to a point 65 where the magnitude of the input data V'ox in the previous cycle is compared with that of the present input data Vox. When Vox<V'ox, that is when the engine is in the rich condition while the output voltage of the $O_2$ sensor 10 is decreasing, the program jumps to the point 64. Contrary to this, when Vox≧V'ox, the program proceeds to a point 66 where the maximum value $V_{MAX}$ of the input data Vox is detected and the detected maximum value $V_{MAX}$ is stored in the RAM, whereafter, the program proceeds to the point 64.

If, at the point 62, it is judged that Vox≧V'ox, i.e., if it is judged that the engine is in the lean condition and Vox is increasing, the program proceeds to points 67 and 68 where a reference value $V_R$ is renewed. At the point 67, a correction factor D is calculated from the equation of $$D = (V_{MAX} + V_{MIN}) \cdot \frac{1}{V_0}$$

where $V_0$ is a constant larger than $V_{MAX}$. This constant $V_0$ may be set to a value corresponding to the constant voltage (for example 5 V) applied to the $O_2$ sensor 10 via the power supply terminal 11. Therefore, the correction factor D is set as $0<D<2$. At the next point 68, the reference value $V_R$ is calculated from the equation of $$V_R = (V_{MAX} - V_{MIN}) \cdot C \cdot D + V_{MIN}$$

Thus, the value $V_R$ stored in RAM is renewed. In the above equation C represents a predetermined operation constant selected as $0<C<0.5$. The program then proceeds to the point 64.

At the point 64, the magnitude of the input data Vox is compared with that of the reference value $V_R$. When Vox≧$V_R$, the program proceeds to a point 69 where the rich flag is turned on. When Vox<$V_R$, the program proceeds to a point 70 where the rich flag is turned off. The program then proceeds to a point 71.

At the point 71, the correction factor $\beta$ for correcting the feedback of the air-fuel ratio is prepared depending upon the on or off condition of the rich flag. The method for preparing the factor $\beta$ is widely known and is not mentioned in detail here. When the rich flag is on, for example, the correction factor $\beta$ is reduced by a predetermined value for each operation cycle. When the rich flag is off, the correction factor $\beta$ is increased by a predetermined value for each operation cycle. Further, when the rich flag is on in the previous operation cycle, but is off in the present operation cycle, or when the rich flag is off in the operation cycle of the previous time, but is on in the present operation cycle, the processing (skip processing) may be so effected that the correction factor $\beta$ is greatly increased or decreased in the present operation cycle. The thus prepared correction factor $\beta$ is stored in the RAM of the memory 40.

Hereinafter, the functions and the effects obtained by the processing routine of FIG. 3 are illustrated.

Figure 4:
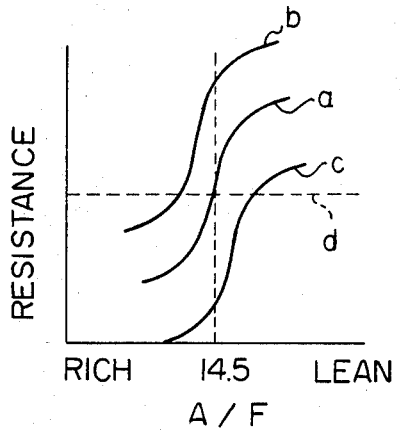
FIG. 4 is a graph illustrating a characteristic of the inner resistance of the $O_2$ sensor with respect to the surrounding air-fuel ratio.

FIG. 4 illustrates a characteristic of the inner resistance versus the air-fuel ratio with respect to a semiconductor type variable resistance $O_2$ sensor which is used in the above-mentioned embodiment. The $O_2$ sensor of this type has, as mentioned hereinbefore, a characteristic of the variable resistance which greatly changes depending upon the surrounding temperature. In FIG. 4, a indicates the A/F-resistance characteristic of the $O_2$ sensor when the normal $O_2$ sensor is operated under an appropriate temperature condition, b indicates that characteristic when the $O_2$ sensor is under a low temperature condition, and c indicates that characteristic when the $O_2$ sensor is under a high temperature condition. The $O_2$ sensor also exhibits the A/F-resistance characteristic shown by b or c in FIG. 4 due to individual sensor differences thereof or when the $O_2$ sensor deteriorates. The resistance value of the resistor 24 shown in FIG. 1 corresponds to the resistance indicated by d in FIG. 4.

Figure 5:
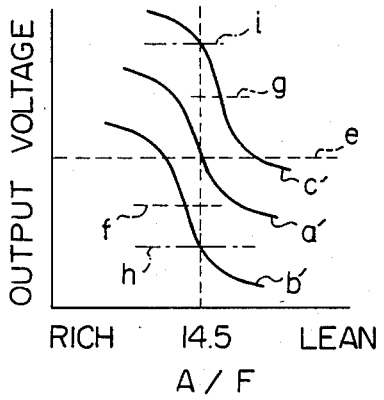
FIG. 5 is a graph illustrating a characteristic of the output voltage from the $O_2$ sensor with respect to the surrounding air-fuel ratio.

FIG. 5 illustrates the characteristic of the output voltage versus the air-fuel ratio with respect to the $O_2$ sensor which has the A/F-resistance characteristic shown in FIG. 4 and which is connected to receive a constant voltage as shown in FIG. 1. In FIG. 5, the temperature conditions of each characteristic indicated by a', b', and c' correspond to that of a, b, and c shown in FIG. 4, respectively. It will be apparent from FIG. 5 that the air-fuel ratio feedback control is difficult in practice if a fixed reference voltage e is used for comparison with respect to the output voltage from the $O_2$ sensor, which output voltage greatly varies along with changes in the surrounding temperature. Furthermore, even if the variable reference value $V_R$ which is changed in response to $V_{MAX}$ or to $V_{MAX}$ and $V_{MIN}$ by using the equation of the first degree, that is, changed by using the equation of $V_R = V_{MAX} \cdot K_1$ or $V_R = (V_{MAX} - V_{MIN}) \cdot K_2 + V_{MIN}$, as shown by f or g in FIG. 5, is used for the comparison, it is difficult to precisely control the air-fuel ratio in the engine because, when the temperature is high, judgement with respect to the air-fuel ratio condition is executed on the rich side relative to the stoichiometric ratio (about 14.5), as shown by b' and f in FIG. 5. Contrary to this, when the temperature is high, the judgement is executed on the lean side relative to the stoichiometric ratio, as shown by c' and g in FIG. 5.

According to the processing routine of FIG. 3, however, since the reference value $V_R$ is calculated from the equation of $V_R = (V_{MAX} - V_{MIN})(V_{MAX} + V_{MIN}) \cdot K_3 + V_{MIN}$ (where $K_3$ is a constant), the air-fuel ratio can be precisely controlled over a wide temperature changing range. Namely, according to the routine of FIG. 3, the reference value $V_R$ is further changed in response to the change of $V_{MAX} + V_{MIN}$ in addition to the reference value $V_R$ obtained by the above-mentioned applicants' method. Therefore, the reference value $V_R$ is changed to a smaller value h than the value f, shown in FIG. 5, when the temperature of the $O_2$ sensor is low and thus the sum of $V_{MAX} + V_{MIN}$ is lowered. On the other hand, the reference value $V_R$ is changed to a larger value i than the value g, shown in FIG. 5, when the temperature of the $O_2$ sensor is high and thus $V_{MAX} + V_{MIN}$ is increased. As a result, the judgement with respect to the air-fuel ratio condition can be always executed at a ratio close to the stoichiometric condition irrespective of the change of the surrounding temperature, and thus precise air-fuel ratio feedback control can be executed over a wide temperature range.

Figures 6A, 6B, 6C:
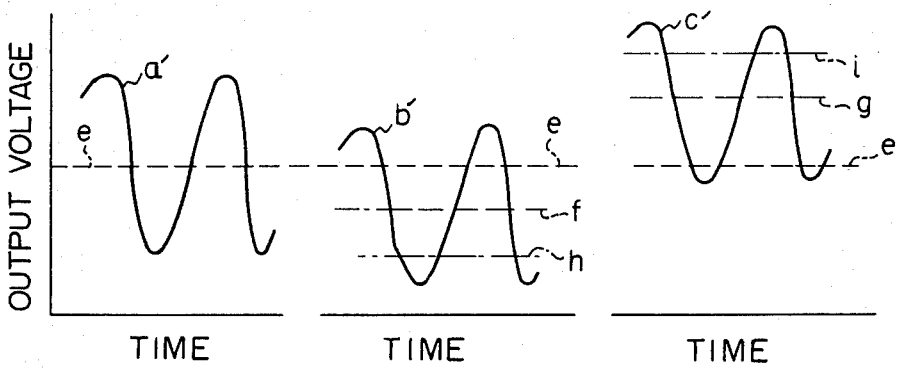
FIGS. 6A, 6B, and 6C are graphs illustrating characteristics of the output voltages from the $O_2$ sensor with respect to time, under various surrounding temperatures.

FIGS. 6A, 6B, and 6C illustrate the characteristic of the output voltage from the $O_2$ sensor versus time. FIG. 6A indicates the characteristic when the temperature of the $O_2$ sensor is appropriate, FIG. 6B the characteristic when the temperature is low, and FIG. 6C the characteristic when the temperature is high. In these figures, each reference symbol indicates the same meaning as in FIG. 5.

Figure 7:
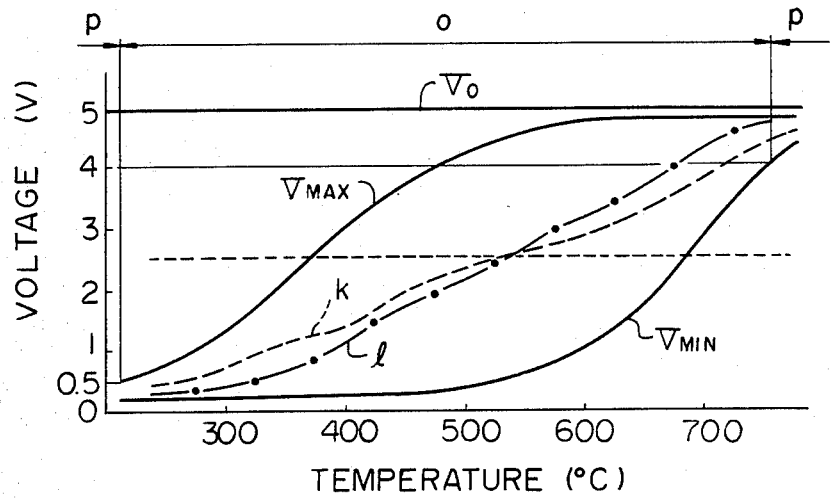
FIG. 7 is a graph illustrating a characteristic of the maximum and minimum values of the output voltage from the $O_2$ sensor with respect to the surrounding temperature.

FIG. 7 illustrates the characteristic of the maximum value $V_{MAX}$ and the minimum value $V_{MIN}$ of the output voltage of the semiconductor type $O_2$ sensor which is used in the present embodiment with respect to the temperature surrounding the $O_2$ sensor. As shown by j in FIG. 7, if the reference value $V_R$ is fixed to a constant, it is quite difficult to perform air-fuel ratio feedback control over a wide temperature range. If the reference value $V_R$ is changed by using the function of $V_R = (V_{MAX} - V_{MIN}) \cdot K_2 V_{MIN}$ as shown by k in FIG. 7, the air-fuel ratio feedback control can be executed over a wide temperature range, but control error caused by temperature change and not compensated for, as shown in FIG. 5, mean precise control of the air-fuel ratio cannot be desired. However, according to the embodiment of the present invention, since the reference value $V_R$ is further corrected depending upon the value of $V_{MAX} + V_{MIN}$, the control errors caused by temperature change are correctly compensated. Namely, as shown by 1 in FIG. 7, when the temperature is low, the reference value $V_R$ decreases under the influence of $V_{MAX}$, and when the temperature is high, the reference value $V_R$ increases under the influence of $V_{MIN}$. As a result, the air-fuel ratio can be precisely controlled according to the present embodiment.

Figure 8:
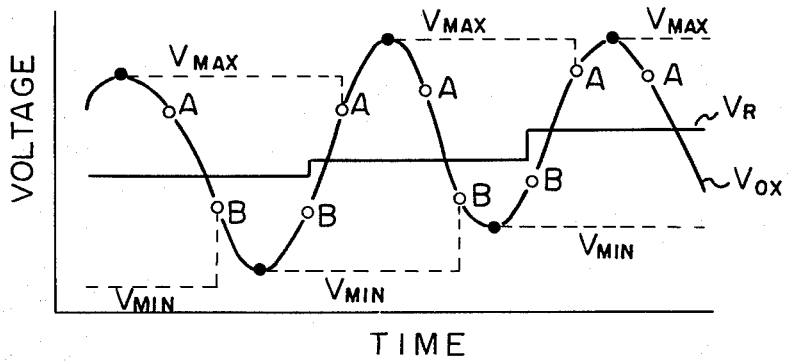
FIGS. 8 and 9 are graphs illustrating the functions of the control programs shown in FIGS. 3, 10, and 11.
Figure 9:
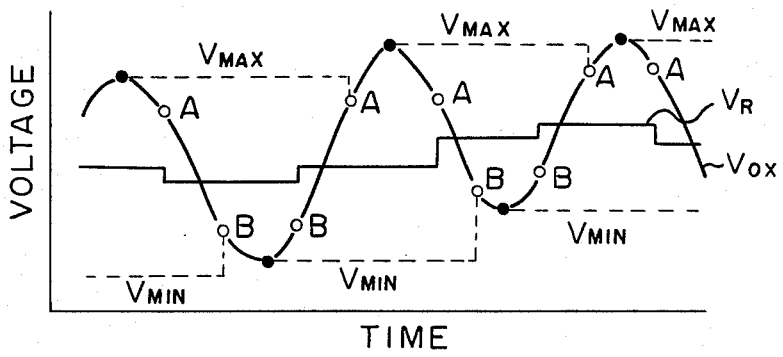

In the processing routine of FIG. 3, the reference value $V_R$ is renewed only when the engine is in the lean condition and Vox is increasing, as shown in FIG. 8. Therefore, $V_R$ is renewed only one time during one cycle of the output voltage from the $O_2$ sensor. However, if the program is modified so that the program proceeds not to the point 66 but to the point 67 from the point 65 as shown by a broken line in FIG. 3 when $Vox < V'ox$, $V_R$ is renewed also when the engine is in the rich condition and Vox is decreasing, as shown in FIG. 9. Thus, $V_R$ is renewed two times during one cycle of the output voltage from the $O_2$ sensor in this case, improving the precision of the air-fuel ratio feedback control.

Figures 10, 10A:
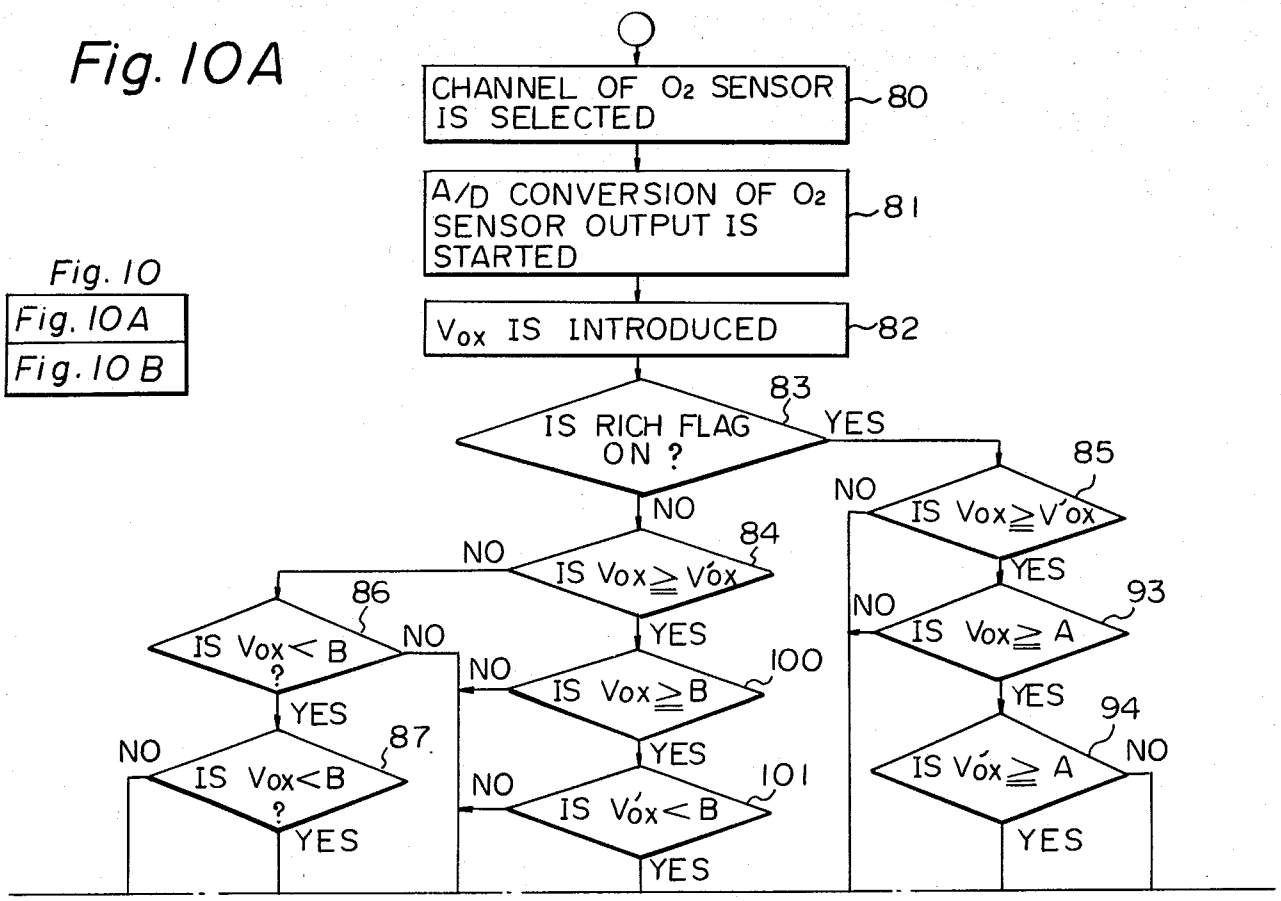
FIG. 10 is a detailed flow diagram of the control program shown in FIG. 3.
Figure 10B:
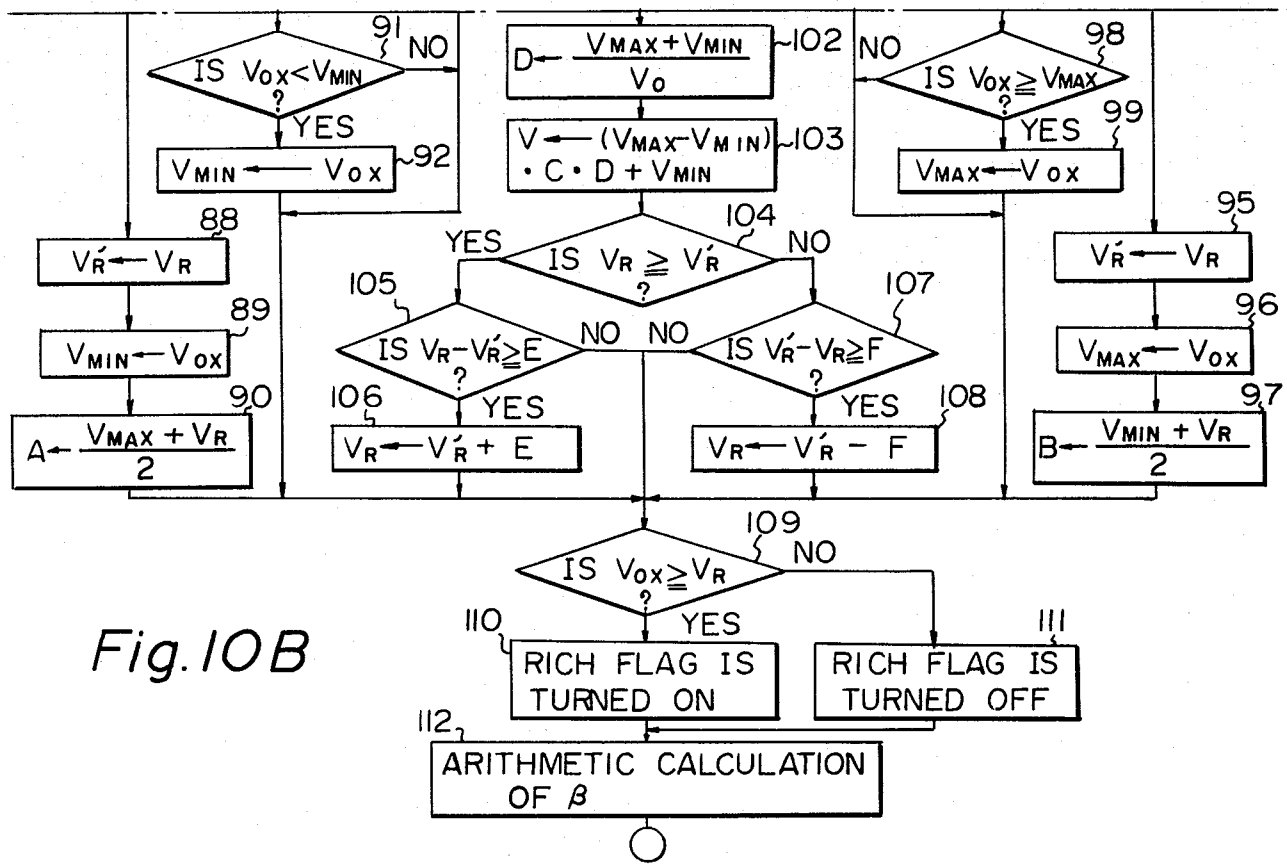

FIG. 10 illustrates a detailed program of the processing routine of FIG. 3. A brief explanation of the processing routine of FIG. 10 will be given hereinafter.

At a point 80, the CPU 32 instructs the multiplexer 28 to select the channel of the $O_2$ sensor 10. At a point 81, the CPU 32 instructs the A/D converter 34 to subject the output voltage of the $O_2$ sensor 10 to the A/D conversion. The procedure at points 82, 83, 84, and 85 is the same as that of the points 60, 61, 62, and 63 of FIG. 3, respectively.

Points 86 through 92 of FIG. 10 correspond to the point 63 of FIG. 3. At the point 86, the CPU 32 judges whether the input data Vox is smaller than a setpoint value B, which is calculated at a point 97 described later. If $Vox < B$, the program proceeds to a point 87 where the CPU 32 judges whether the input data V'ox in the previous cycle is smaller than the setpoint value B. If it is judged that $V'ox \geqq B$ at the point 87, i.e., if the input data V'ox of the previous cycle is $V'ox \geqq B$ but the input data Vox of the present cycle is $Vox < B$, the program proceeds to points 88 through 90 and renewing operation of the minimum value $V_{MIN}$ is started. In the succeeding operation cycles, since V'ox will be smaller than B, the program proceeds from the point 87 to points 91 and 92 where a true minimum value $V_{MIN}$ is detected. At the point 91, when the input data Vox decreases to a value smaller than B the minimum value $V_{MIN}$ detected in the previous operation cycle is compared with the input data Vox of the present operation cycle, as shown in FIG. 8. If $Vox < V_{MIN}$, $V_{MIN}$ is equalized to Vox at the point 92. By repeating the above procedure, the true minimum value $V_{MIN}$ can be detected. The point 88 is provided for holding the reference value $V'_R$ before renewing, which value $V'_R$ will be used in the steps at points 104 through 108. The point 90 is provided for calculating a setpoint value A which is used for detecting the maximum value $V_{MAX}$. Namely, at the point 90, the setpoint value A is calculated from the equation of $$A = \frac{V_{MAX} + V_R}{2}$$

Points 93 through 99 of FIG. 10 corresponds to the point 66 of FIG. 3. At these points 93 through 99, the maximum value $V_{MAX}$ of the input data Vox is detected by a method similar to but opposite from that at the points 86 through 92. At the point 98, when the input data Vox increases to a value larger than or equal to the setpoint value A, the maximum value $V_{MAX}$ detected in the previous operation cycle is compared with the input data, Vox of the present operation cycle, as shown in FIG. 8. If $V_{MAX} \leqq$ Vox, $V_{MAX}$ is equalized to Vox at the point 99. By repeating the above procedure, the true maximum value $V_{MAX}$ is detected. The point 95 is provided for holding the reference value $V'_R$ before renewing. The point 97 is provided for calculating the setpoint value B which is used for detecting the minimum value $V_{MIN}$. Namely, at the point 97, the setpoint value B is calculated from the equation of $$B = \frac{V_{MIN} + V_R}{2}.$$

Points 100 and 101 are provided for executing the renewing operation of the reference value $V_R$ only when Vox increases and passes through B, as shown in FIG. 8. The procedure at points 102 and 103 is the same as that of the points 67 and 68 of FIG. 3. Points 104 through 108 are provided for restricting the difference between the renewed reference value $V_R$ and the reference value $V'_R$ before renewing to certain values. According to the process at these points, the renewed reference value $V_R$ is restricted within $V'_R - F \leqq V_R \leqq V'_R + E$, where E and F are constants. As a result, $V_R$ does not suddenly change in response to the temporary deviations of the amplitude of the $O_2$ sensor output, and thus error of the air-fuel ratio control can be prevented. The procedure at points 109, 110, 111, and 112 is the same as that of the points 64, 69, 70, and 71 of FIG. 3, respectively.

Figure 11:
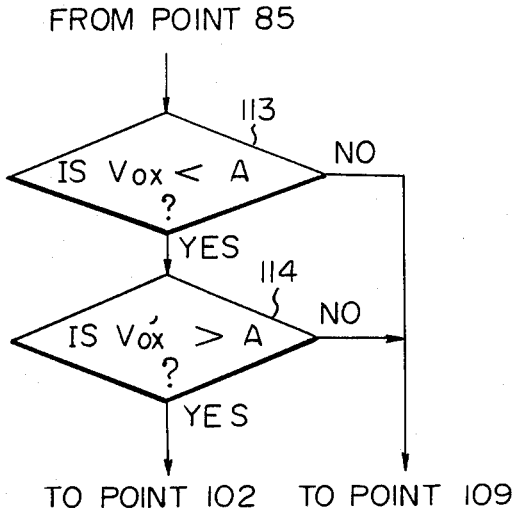
FIGS. 11, 12 and 13 are flow diagrams of parts of control programs of other embodiments.

FIG. 11 illustrates the modified part of another program with respect to the processing routine of FIG. 3. According to the program of FIG. 11, if it is judged that Vox < V'ox at the point 85 shown in FIG. 10, the program proceeds to points 113 and 114 rather than jumping to the point 109. These points 113 and 114 are provided for executing the renewing operation of the reference value $V_R$ not only when Vox increases and passes through B but also when Vox decreases and passes through A, as shown by FIG. 9. Therefore, according to the processing routine of FIG. 11, $V_R$ is renewed two times during one cycle of the output voltage from the $O_2$ sensor.

In the processing routines of FIGS. 10 and 11, determination of whether the maximum value $V_{MAX}$, minimum value $V_{MIN}$, and reference value $V_R$ should be renewed is made by utilizing the setpoint values A and B as threshold values. This is effected for the purpose that when the air-fuel ratio in the exhaust gas is nonuniformly distributed, the control point for the air-fuel ratio is corrected to a proper position without deviation, and so that excess correction of the air-fuel ratio is prevented.

According to the above-mentioned embodiment, the reference value for comparing the output value from the $O_2$ sensor with respect to magnitude is calculated by adding up the minimum value of the $O_2$ sensor output and the product of a first value, which first value is proportional to the difference between the maximum value of the $O_2$ sensor output and the minimum value, and a second value, which second value is proportional to the sum of the maximum and minimum values. Therefore, if the output voltage from the $O_2$ sensor greatly changes in response to the change in its surrounding temperature, or if the output voltage greatly deviates in accordance with individuals $O_2$ sensor differences or with the deterioration of the $O_2$ sensor, the air-fuel ratio can be precisely and appropriately controlled without producing any control errors.

Figures 12, 12A, 12B:
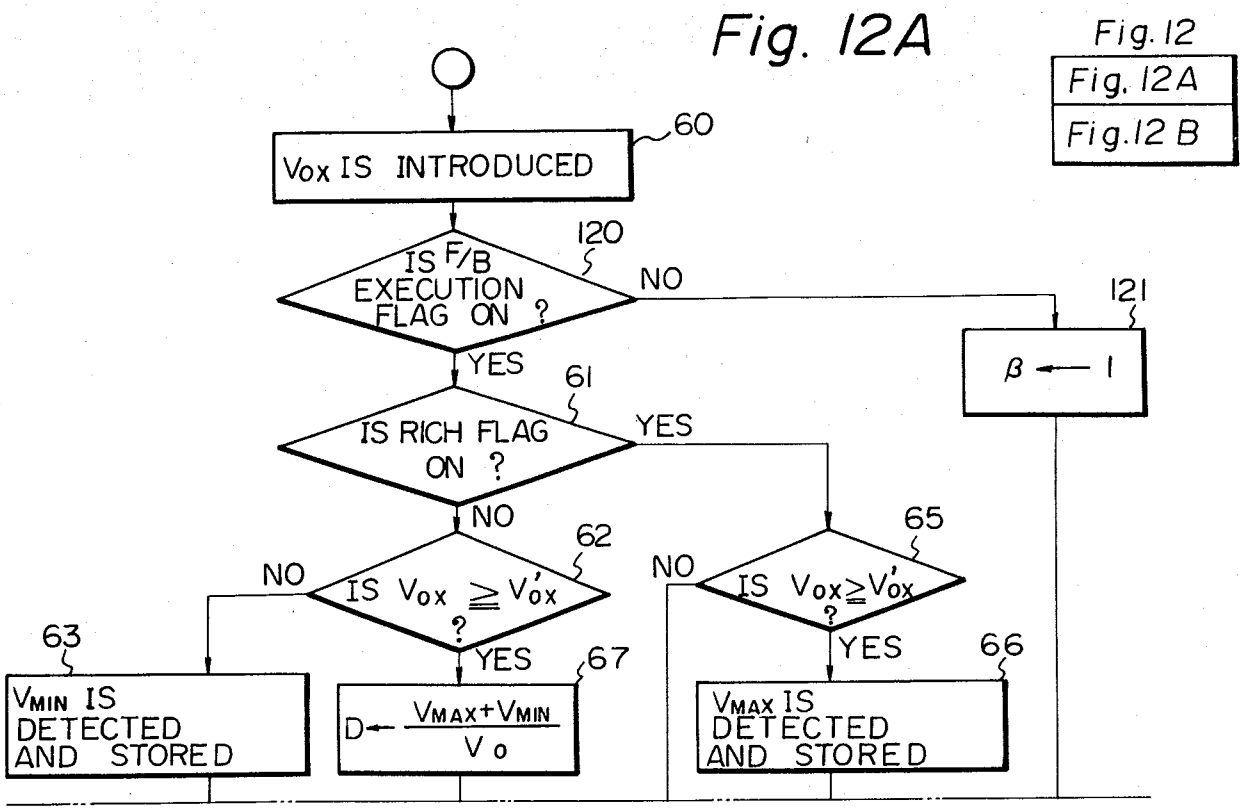
Figure 12B:
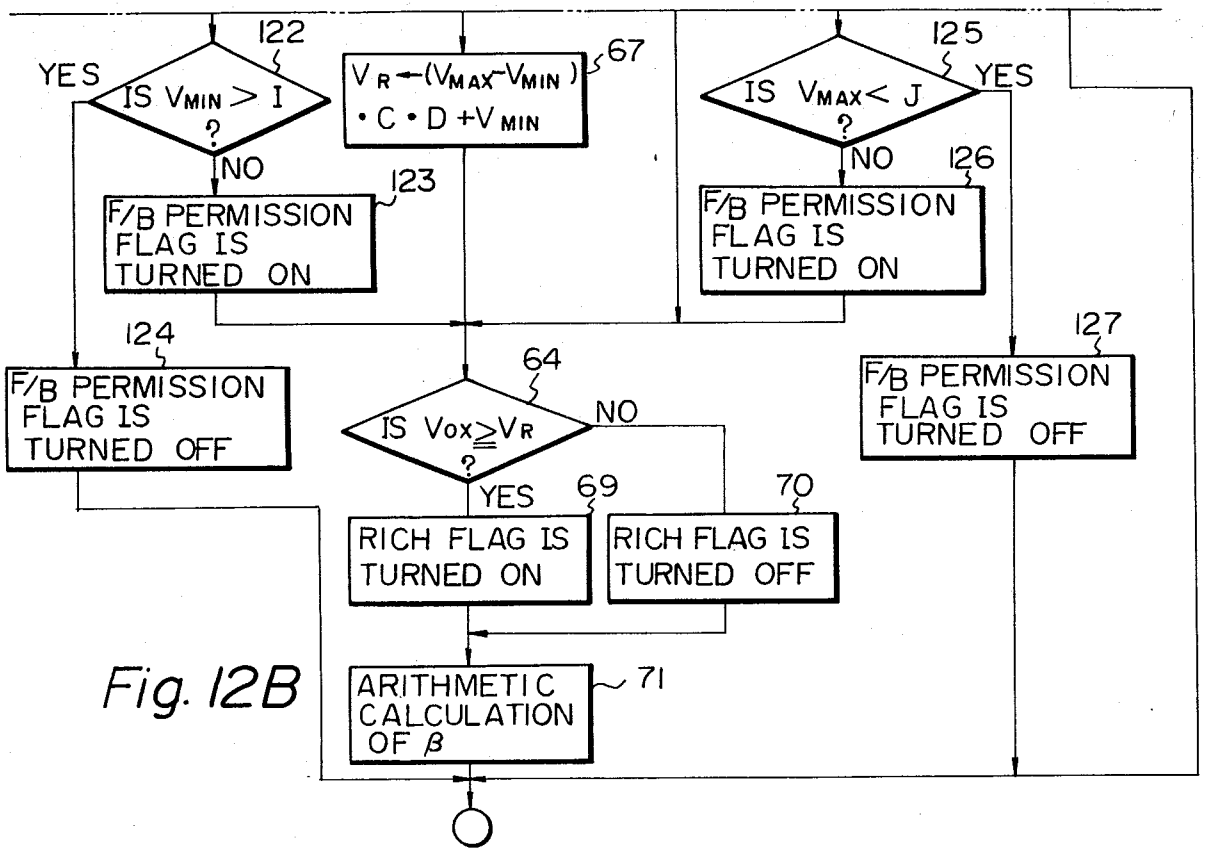

FIG. 12 schematically illustrates another routine for calculating the correction factor $\beta$ used in the routine of FIG. 2. The procedure of the processing routine of FIG. 12 is the same that of FIG. 10 except for the following portions.

At the point 120 next to the point 60, the CPU 22 judges whether an F/B (feedback) execution flag is on or not. If the F/B execution flag is off, the program proceeds to a point 121. At the point 121, the correction factor $\beta$ is fixed to 1.0, namely the operation of $\beta \leftarrow 1.0$ is executed, and then, the fixed correction factor $\beta$ is stored in the RAM of the memory 40. Thereafter, the calculation cycle of the routine of FIG. 12 is finished. When the correction factor $\beta$ is fixed to 1.0, the feedback control (closed-loop control) of the air-fuel ratio in response to the output voltage from the $O_2$ sensor is stopped, as apparent from the calculation at the point 52 of FIG. 2. If the F/B execution flag is on, the program proceeds to the point 61.

At the point 122 next to the point 63, the magnitude of the detected minimum value $V_{MIN}$ is compared with that of a predetermined upper limit value I. If the constant voltage applied to the $O_2$ sensor 10 via the terminal 11 shown in FIG. 1 is 5 V, the above upper limit value I is set to a value corresponding to 4 V. If $V_{MIN} \leqq$ I, the program proceeds from the point 122 to a point 124 where the F/B permission flag is turned off in order to stop the feedback control of the air-fuel ratio, then finishing the present operation cycle.

At the point 125 next to the point 66, the magnitude of the detected maximum value $V_{MAX}$ is compared with that of a predetermined lower limit value J. If the constant voltage applied to the $O_2$ sensor 10 via the power supply terminal 11 shown in FIG. 1 is 5 V, the lower limit value J is set to a value corresponding to 0.5 V. If $V_{MAX} >$ J, the program proceeds from the point 125 to a point 126 where the F/B permission flag is turned on, then proceeds to the point 64. If $V_{MAX} <$ J, the program proceeds from the point 125 to a point 127 where the F/B permission flag is turned off in order to stop the feedback control of the air-fuel ratio, then finishes the present operation cycle.

Figure 13:
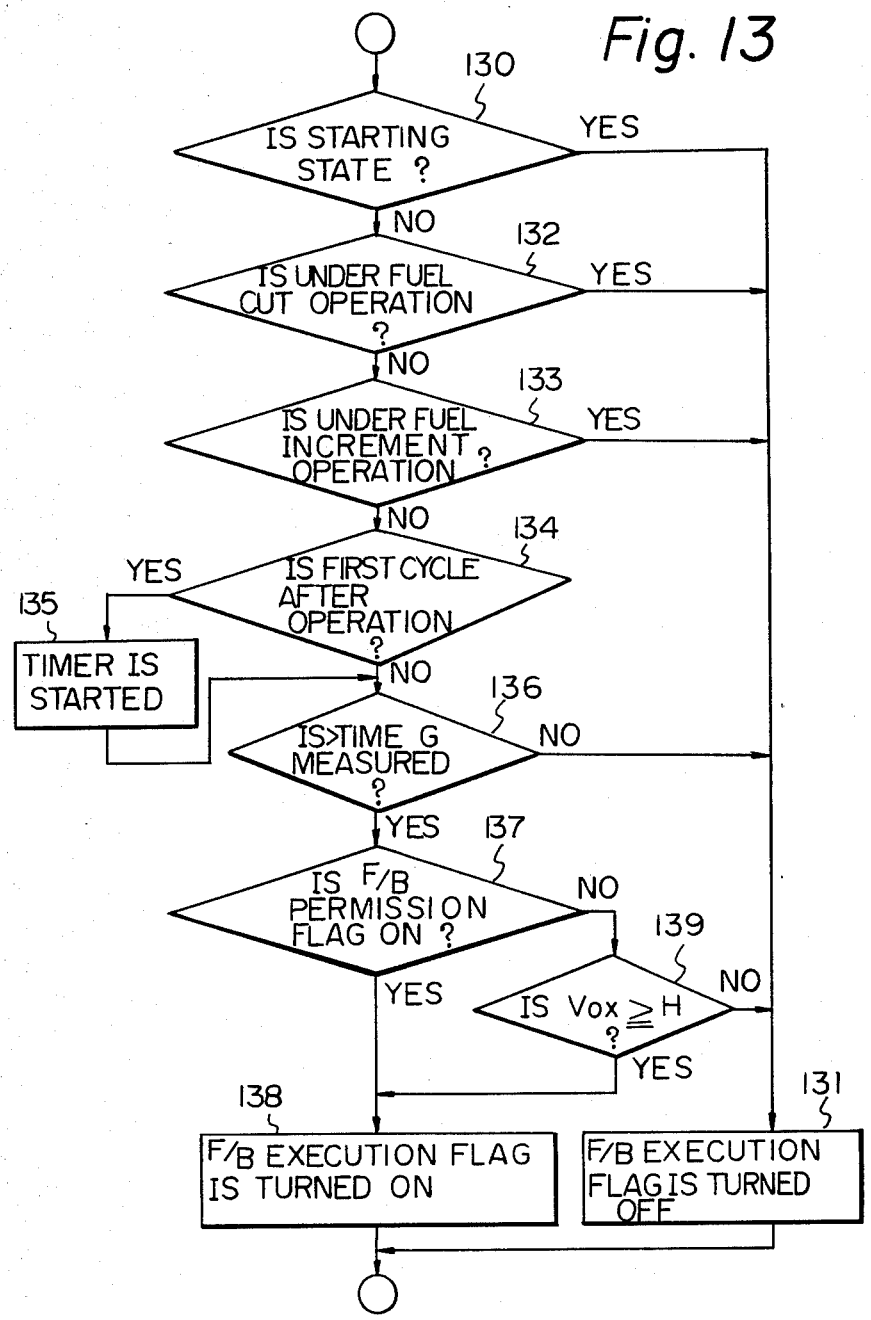

FIG. 13 is a flow diagram of an interruption processing routine for controlling the F/B execution flag. The CPU 32 disrupts the operation of the main routine of FIG. 12 and executes the operation of the interruption routine of FIG. 13 in response to an interruption requiring a signal which appears at every predetermined period of time, for example, at every 12.8 msec. At a point 130, first the CPU 32 judges whether the starter motor 23 is energized, in other words, whether the engine is under the starting state. If it is under the starting state, the program jumps to a point 131 where the F/B execution flag is turned off, then returns to the main routine. During the starting state, since the F/B execution flag is thus turned off, the program in the main routine proceeds from the point 120 to the point 121 causing the feedback control of the air-fuel ratio to be stopped.

Contrary to this, if the engine is not under the starting state, the program proceeds to a point 132 where the CPU 32 discriminates whether the engine is under fuel cut operation. If under fuel cut operation, the program jumps to the point 131 to turn off the F/B execution flag causing the feedback control of the air-fuel ratio to be stopped. If no fuel cut operation is executed, the program proceeds to a point 133 where whether the engine is under the fuel increment operation is discriminated. If it is judged that the fuel increment operation according to the signal from the throttle position switch 22 is now executed, the F/B execution flag is turned off at the point 131. This is because during the fuel increment operation caused by, for example, acceleration, the feedback control operation of the air-fuel ratio should be stopped. If it is not under the fuel increment operation, the program proceeds to a point 134. At the point 134, the CPU 32 judges whether the present interruption cycle is the first interruption cycle after the fuel cut operation or after the fuel increment operation. If the first interruption cycle, the program proceeds to a point 135 where a timer is started to measure the lapse of time after the fuel cut operation or after the fuel increment operation, then proceeds to a point 136. If it is not the first interruption cycle, the program directly proceeds to the point 136. At the point 136, the CPU 32 discriminates whether or not the measured lapse of time exceeds a predetermined period G of time. If the lapse time is shorter than the period G, the program proceeds to the point 131 where the F/B execution flag is turned off. Contrary to this, when the lapse time exceeds the period G, the program proceeds to a point 137.

The above-mentioned processing routine from the point 134 to the point 136 operates to delay the start of the feedback control by a predetermined period of time after the fuel cut operation or after the fuel increment operation in order to precisely control the air-fuel ratio. Since the output voltage of the $O_2$ sensor 10 is fixed to the minimum value during the fuel cut operation or to the maximum value during the fuel increment operation, the reference value $V_R$ extremely deviates if the value $V_R$ is calculated just after the fuel cut operation or the fuel increment operation. If the calculated reference value $V_R$ deviates, the air-fuel ratio will be controlled to a quite wrong value greatly reducing the purifying effectiveness of the three-way catalytic converter and also extraordinarily increasing the temperature of the exhaust gas. Therefore, according to the processing routine of points 134 to 136, the start of the feedback control is delayed by a predetermined period of time after the fuel cut or fuel increment operation. The above-mentioned period G is determined in accordance with a delay time of the feedback control, which delay time includes a delay in passing the combustion gas from an intake system to an exhaust system of the engine and a response delay of the $O_2$ sensor.

At the point 137, the CPU 32 judges whether the F/B permission flag which is controlled at the points 123 and 126 or at the points 124 and 127 of the main routine is on. If the F/B permission flag is on, the program proceeds to the point 128 where the F/B execution flag is turned on, then returns to the main routine. As a result, in the main routine, the program proceeds from the point 120 to the point 61, so that the feedback control of the air-fuel ratio is carried out.

If it is judged that the F/B permission flag is off at the point 137, the program proceeds to a point 139 where whether the input data Vox which corresponds to the output voltage of the $O_2$ sensor 10 is greater than or equal to a predetermined value H is discriminated. If $Vox \geqq H$, the F/B execution flag is turned on at a point 138. On the contrary, if $Vox < H$, the F/B execution flag is turned off at the point 131.

In the processing routine of the points 122 and 125, the F/B permission flag is controlled to be turned on and turned off in accordance with judgement whether the minimum value $V_{MIN}$ is larger than the upper limit value I, and with judgement whether the maximum value $V_{MAX}$ is smaller than the lower limit value J, respectively. Generally, when the F/B permission flag is off, the F/B execution flag is turned off causing the feedback control operation to be stopped. However, if it is recognized at a point 139 that the output voltage of the $O_2$ sensor 10 increases owing to the change in the operating condition of the engine, which change is followed by increasing the temperature of the exhaust gas, and that the output voltage exceeds a predetermined value H, the F/B execution flag is turned on causing the feedback control operation to be carried out.

When the semiconductor type $O_2$ sensor 10 is connected as shown in FIG. 1 and the constant voltage of 5 V is supplied thereto via the power supply terminal, the minimum value $V_{MIN}$ of the output voltage from the $O_2$ sensor 10 approaches 5 V, as shown in FIG. 7 under a very high temperature condition. Under a very high temperature condition, it is difficult to precisely control by closed-loop the air-fuel ratio without producing any error even when the reference value $V_R$ is variably controlled as indicated by l and k in FIG. 7. Therefore, according to the embodiment with respect to FIGS. 12 and 13, the closed loop control of the air-fuel ratio responsive to the $O_2$ sensor output is stopped and the air-fuel ratio is controlled by open loop when the minimum value $V_{MIN}$ exceeds a value corresponding to 4 V. As a result, a more preferable air-fuel ratio control can be executed. On the other hand, since the maximum value $V_{MAX}$ of the output voltage from the $O_2$ sensor 10 approaches 0 V under the very low temperature condition as shown in FIG. 7, the closed loop control of the air-fuel ratio is stopped and the air-fuel ratio is controlled by open loop when the maximum value $V_{MAX}$ becomes lower than a value corresponding to 0.5 V. As a result, a more desirable air-fuel ratio control can be performed. In FIG. 7, reference symbol o represents the closed loop control region, and p represents the open loop control region.

According to the above-mentioned embodiment, the closed loop control of the air-fuel ratio is stopped depending upon the maximum value $V_{MAX}$ of the output voltage from the $O_2$ sensor and/or the minimum value $V_{MIN}$ of the $O_2$ sensor's output voltage. Therefore, it is possible to certainly and precisely recognize an operative temperature range wherein the $O_2$ sensor is active, causing the air-fuel ratio control to be precisely executed without producing any control errors. Furthermore, since no exhaust gas temperature sensor is required, the constitution of the air-fuel ratio control system can be simplified, and the manufacturing cost of the system can be reduced.

As many widely different embodiments of the present invention may be constructed without departing from the spirit and scope of the present invention, it should be understood that the present invention is not limited to the specific embodiments described in this specification, except as defined in the appended claims.

We claim:

1. An air-fuel ratio control method of an internal combustion engine having at least one fuel injection valve, an exhaust gas sensor for detecting the concentration of a predetermined component in the exhaust gas and for generating a voltage signal which represents the detected concentration, and an electrical digital computer, said method comprising the steps of:

intermittently sampling the voltage signal from said exhaust gas sensor to produce a first electrical signal indicative of the sampled voltage;

detecting the operating condition of the engine to produce a second electrical signal indicative of the detected operating condition;

finding a maximum value and a minimum value of said first electrical signal to produce a maximum signal and a minimum signal by means of said digital computer in accordance with said maximum value and said minimum value, respectively;

calculating, in response to said maximum signal and said minimum signal, a first value which is proportional to the difference between the maximum value and the minimum value, and a second value which is proportional to the sum of the maximum value and the minimum value, by means of said digital computer;

calculating, by means of said digital computer, a reference value in accordance with said first and second values and said minimum value, said reference value corresponding to the sum of the minimum value and the product of the first and second values;

comparing, by means of said digital computer, the magnitude of the reference value with said first electrical signal to produce a third electrical signal indicative of the comparison result;

calculating, in response to said second and third electrical signals, the fuel feeding rate to the engine to produce a fourth electrical signal indicative of the calculated fuel feeding rate, by means of said digital computer;

converting said fourth electrical signal into a pulse signal having a variable pulse width which corresponds to said fourth electircal signal; and actuating, in response to said pulse signal, said fuel injection valve.

2. A method as in claim 1, wherein said first and second value calculating step includes a step of calculating, in response to said maximum signal and said minimum signal, said first value by multiplying the difference between the maximum value and the minimum value by a first constant, and said second value by multiplying the sum of the maximum value and the minimum value by a second constant, said first and second constants being predetermined so that said calculated reference value is restricted within the range between said maximum value and said minimum value.

3. A method as in claim 1, wherein said reference value calculating step is carried out while said first electrical signal increases from the detected value of said minimum signal to the reference signal value.

4. A method as in claim 1, wherein said reference value calculating step is carried out while said first electrical signal increases from the detected value of said minimum signal to the reference signal value, or while said first electrical signal decreases from the detected value of said maximum signal to the reference signal value.

5. A method as in claim 1, wherein said finding step is performed only when said first electrical signal resulting in said maximum value is greater than a first setpoint and said first electrical signal resulting in said minimum value is less than a second setpoint.

6. A method as in claim 5, wherein said first setpoint value is selected between a value of the maximum signal in a previous cycle and a value of the reference value in a previous cycle.

7. A method as in claim 6, wherein said second setpoint value is selected between a value of the minimum signal in a previous cycle and a value of the reference value in a previous cycle.

8. A method as in claim 6 or 7, wherein said first setpoint value is determinded by the mean value of the maximum signal in said previous cycle and the reference value in said previous cycle.

9. A method as in claim 8, wherein said second setpoint value is determined by the mean value of the minimum signal in said previous cycle and the reference value in said previous cycle.

10. A method as in claim 1, wherein said method further comprises a step of restricting the difference between values of the reference values in said previous cycle and in the present cycle within a predetermined range.

11. A method as in claim 1, wherein said method further comprises a step of calculating, in response to only said second electrical signal, the fuel feeding rate to the engine to produce a fifth electrical signal indicative of the calculated fuel feeding rate, and wherein said converting step converts said fifth electrical signal instead of said fourth electrical signal into a pulse signal having a variable pulse width which corresponds to said fifth electrical signal, only when said maximum value is smaller than a third setpoint which is smaller than the reference value.

12. A method as in claim 1, wherein said method further comprises a step of calculating, in response to only said electrical signal, the fuel feeding rate to the engine to produce a fifth electrical signal indicative of the calculated fuel feeding rate, and wherein said converting step converts said fifth electrical signal instead of said fourth electrical signal into a pulse signal having a variable pulse width which corresponds to said fifth electrical signal, only when said minimum value is greater than a third setpoint which is greater than the reference value.

13. An apparatus for controlling the air-fuel ratio in an internal combustion engine comprising:

an exhaust gas sensing means for detecting the concentration of a predetermined component in the exhaust gas of the engine and for generating a voltage signal which represents the detected concentration;

means for intermittently sampling the voltage signal from said exhaust gas sensing means to produce a first electrical signal indicative of the sampled voltage;

means for detecting an operating condition of the engine to produce a second electrical signal indicative of the detected operating condition;

an electrical digital computer, said computer including means for (1) finding a maximum value and a minimum value of said first electrical signal to produce a maximum signal and a minimum signal by means of said digital computer in accordance with said maximum value and said minimum value, respectively, (2) calculating, in response to said maximum signal and said minimum signal, a first value which is proportional to the difference between the maximum value and the minimum value, and a second value which is proportional to the sum of the maximum value and the minimum value, (3) calculating a reference value in accordance with said first and second values and said minimum value, said reference value corresponding to the sum of the minimum value and the product of the first and second values, (4) comparing the magnitude of the reference value with said first electrical signal to produce a third electrical signal indicative of the comparison result, and (5) calculating, in response to said second and third electrical signals, a fuel feeding rate for the engine to produce a fourth electrical signal indicative of the calculated fuel feeding rate;

means for converting said fourth electrical signal into a pulse signal having a variable pulse width which corresponds to said fourth electrical signal; and means for actuating, in response to said pulse signal, said fuel injection value.

14. An apparatus as in claim 13 wherein said computer performs said first and second value calculating function by calculating, in response to said maximum signal and said minimum signal, a first value by multiplying the difference between the maximum value and the minimum value by a first constant, and a second value by multiplying the sum of the maximum value and the minimum value by a second constant, said first and second constants being predetermined so that said calculated reference value is restricted within the range between said maximum value and said minimum value.

15. An apparatus as claimed in claim 13, wherein said computer performs said reference value calculating function while said first electrical signal increases from the detected value of said minimum signal to the reference signal value.

16. An apparatus as in claim 13, wherein said computer performs said reference value calculating function while said first electrical signal increases from the detected value of said minimum signal to the reference signal value, or while said first electrical signal decreases from the detected value of said maximum signal to the reference signal value.

17. An apparatus as in claim 13, wherein said computer performs said finding function only when said first electrical signal resulting in said maximum value is greater than a first setpoint and said first electrical signal resulting in said minimum value is less than a second setpoint.

18. An apparatus as in claim 17, wherein said first setpoint value is selected between a value of the maximum signal in a previous cycle and a value of the reference value in a previous cycle.

19. An apparatus as in claim 18, wherein said second setpoint value is selected between a value of the minimum signal in a previous cycle and a value of the reference value in a previous cycle.

20. An apparatus as in claim 18 or 19, wherein said first setpoint value is determined by mean value of the maximum signal in said previous cycle and the reference value in said previous cycle.

21. An apparatus as in claim 18, wherein said second setpoint value is determined by the mean value of the minimum signal in said previous cycle and the reference value in said previous cycle.

22. An apparatus as in claim 13, said apparatus further comprising means for restricting the difference between values of the reference values in said previous cycle and in the present cycle within a predetermined range.

23. An apparatus as claimed in claim 13, wherein said computer further includes means for calculating, in response to only said second electrical signal, the fuel feeding rate to the engine to produce a fifth electrical signal indicative of the calculated fuel feeding rate, and wherein said converting means converts said fifth electrical signal instead of said fourth electrical signal into a pulse signal having a variable pulse width which corresponds to said fifth electrical signal, only when said maximum value is smaller than a third setpoint which is smaller than the reference value.

24. An apparatus as claimed in claim 13, wherein said computer further includes means for calculating, in response to only said second electrical signal, the fuel feeding rate to the engine to produce a fifth electrical signal indicative of the calculated fuel feeding rate, and wherein said converting means converts said fifth electrical signal instead of said fourth electrical signal into a pulse signal having a variable pulse width which corresponds to said fifth electrical signal, only when said minimum value is greater than a third setpoint which is greater than the reference value.

* * * * *